US006810680B2

(12) United States Patent
Pohl et al.

(10) Patent No.: US 6,810,680 B2
(45) Date of Patent: Nov. 2, 2004

(54) ICE MAKER FILL TUBE ASSEMBLY

(75) Inventors: Douglas A. Pohl, Davenport, IA (US); William James Vestal, Monmouth, IL (US); Kenton John Widmer, Knoxville, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/355,085

(22) Filed: Jan. 31, 2003

(65) Prior Publication Data

US 2004/0148957 A1 Aug. 5, 2004

(51) Int. Cl.[7] ..... F25C 5/02
(52) U.S. Cl. ..... 62/71; 62/420
(58) Field of Search ..... 62/347, 340, 300, 62/71, 75, 353, 420

(56) References Cited

U.S. PATENT DOCUMENTS

| | | | | | |
|---|---|---|---|---|---|
| 3,744,270 | A | | 7/1973 | Wilcox | |
| 3,755,994 | A | | 9/1973 | Bidiwala | |
| 3,775,994 | A | * | 12/1973 | Linstromberg et al. | 62/177 |
| 3,835,661 | A | | 9/1974 | Kochendorfer et al. | |
| 3,866,434 | A | * | 2/1975 | Pugh et al. | 62/340 |
| 3,937,032 | A | * | 2/1976 | Bright | 62/135 |
| 4,020,644 | A | | 5/1977 | True, Jr. et al. | |
| 4,142,378 | A | * | 3/1979 | Bright et al. | 62/135 |
| 4,191,025 | A | | 3/1980 | Webb | |
| 4,272,025 | A | * | 6/1981 | Mazzotti | 239/240 |
| 4,341,087 | A | * | 7/1982 | Van Steenburgh, Jr. | 62/233 |
| 4,366,679 | A | * | 1/1983 | Van Steenburgh, Jr. | 62/347 |
| 4,632,280 | A | * | 12/1986 | Mawby et al. | 222/275 |
| 4,635,444 | A | | 1/1987 | Mawby et al. | |
| 4,680,943 | A | | 7/1987 | Mawby et al. | |
| 5,924,301 | A | * | 7/1999 | Cook | 62/347 |
| 5,964,617 | A | * | 10/1999 | Hoang et al. | 439/528 |
| 6,148,624 | A | * | 11/2000 | Bishop et al. | 62/137 |
| 6,157,777 | A | | 12/2000 | Banks et al. | |
| 6,470,701 | B2 | * | 10/2002 | Tchougounov et al. | 62/347 |
| 6,490,873 | B2 | * | 12/2002 | Tchougounov | 62/71 |
| 6,574,982 | B1 | * | 6/2003 | Wiseman et al. | 62/347 |
| 2001/0011461 | A1 | | 8/2001 | Tchougounov et al. | |

FOREIGN PATENT DOCUMENTS

| | | | | |
|---|---|---|---|---|
| JP | 402126070 | A | * | 5/1990 |

* cited by examiner

*Primary Examiner*—William Doerrler
*Assistant Examiner*—Mohammad M. Ali
(74) *Attorney, Agent, or Firm*—Diederiks & Whitelaw, PLC

(57) ABSTRACT

An ice maker assembly in a refrigerator freezer includes a fill tube for transporting liquid to a mold. The freezer includes an outer wall spaced apart from an inner wall, with a plenum formed therebetween. An opening is formed within the inner wall, through which the fill tube extends with a clearance. Warm air generated by a defrost cycle passes through the clearance in the inner wall and around the fill tube, thereby warming the fill tube. In addition, the fill tube includes vents formed therein to allow active ventilation of the fill tube and to prevent ice formation within the fill tube.

14 Claims, 2 Drawing Sheets

ICE MAKER FILL TUBE ASSEMBLY

BACKGROUND OF THE INVENTION

1. Field of the Invention

The present invention pertains to the art of refrigerators, and, more particularly, to a fill tube arrangement for an ice maker assembly provided in a freezer of a refrigerator.

2. Discussion of the Prior Art

Providing automatic ice makers in household refrigerators has become extremely commonplace. Ice makers typically include a tray that is filled by a water fill tube extending through a wall of a freezer compartment.

Since the ice maker fill tube extends into the freezer compartment, a problem exists in that water can freeze within the tube and lead to clogging of the tube. Several attempts have been made to solve this problem. For example, U.S. Pat. No. 4,020,644 discloses a water supply line that is maintained in contact with the freezer compartment outer case over a pre-selected length of the fill tube sufficient to prevent freezing of water in the fill tube. In addition, the fill tube is insulated with foam material. In the arrangement of the '644, patent, there is still a possibility that the tube may freeze. More particularly, only a portion of the tube is in heat exchange relationship with the outer case. Therefore, any heat provided by the outer case may not be sufficient to prevent freezing of other portions of the fill tube. Further, the tube is surrounded by foam and may be difficult to remove if it is necessary to clear an ice blockage within the tube.

Another attempt to solve the problem of ice formation in an ice maker fill tube is demonstrated by U.S. Pat. No. 6,157,777. In this arrangement, an ice maker fill tube includes a heater for maintaining a fluid within the tube at or above a predetermined temperature. The fill tube and heater are integrally formed so the heater is protected from physical damage. However, this arrangement adds significantly to the costs associated with manufacturing the fill tube and ice maker. Additionally, the heater arrangement will certainly affect installation and repair costs associated with the fill tube and ice maker.

Based on the known prior art, there is a need in the art for an ice maker fill tube assembly that prevents ice from freezing within the fill tube. Further, there is a need for an assembly that is inexpensive to manufacture, easy to maintain, and provides reliable protection against ice build-up.

SUMMARY OF THE INVENTION

The present invention is directed to a fill tube arranged for an ice maker assembly in a freezer compartment of a refrigerator, wherein the fill tube functions to transport liquid from a reservoir to a mold. The freezer includes an outer wall spaced apart from an inner wall, and a plenum formed therebetween. An opening is formed within the inner wall, through which the fill tube extends with a desired clearance. Warm air generated by a defrost cycle passes through the clearance in the inner wall and around the fill tube, thereby warming the fill tube.

In addition, the fill tube is formed with vents to allow active ventilation of the fill tube in order to prevent ice formation within the fill tube. Particularly, warm air generated by a defrost cycle is allowed to enter the vents formed within the fill tube to prevent freezing of the fill tube. The fill tube is also exposed to dehumidified freezer air from behind the inner wall. The dehumidified freezer air helps to prevent ice formation on the surface of the fill tube, as well as ice restrictions within the fill tube.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
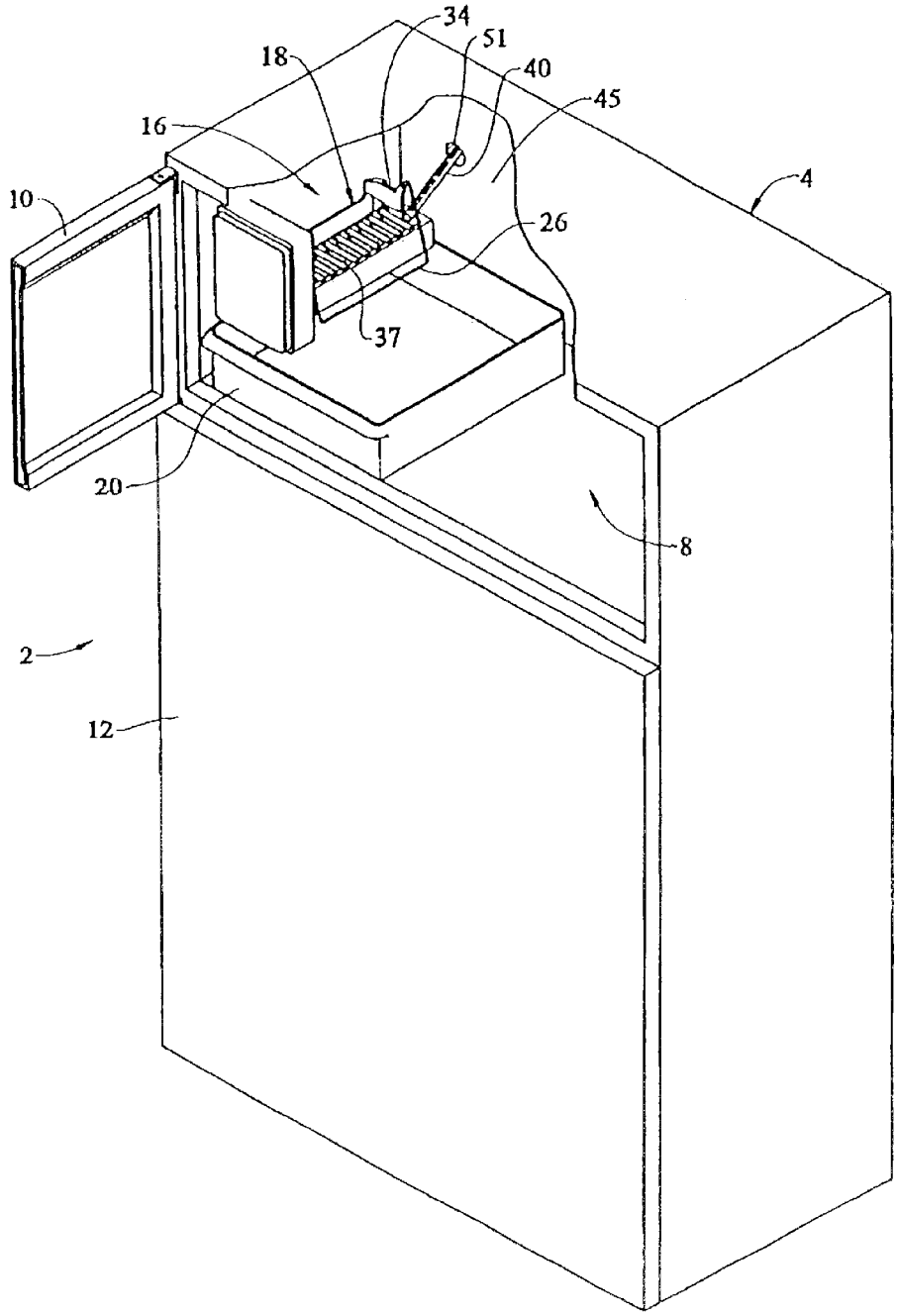
FIG. 1 is a partial sectional view of a refrigerator having a freezer compartment incorporating the ice maker fill tube assembly constructed in accordance with the present invention.

With initial reference to FIG. 1, a refrigerator 2 includes a cabinet 4 within which is defined a freezer compartment 8. Freezer compartment 8 can be selectively accessed through the pivoting of a freezer door 10. Also provided is a fresh food door 12 which enables access to a fresh food compartment (not shown). As shown, refrigerator 2 constitutes a top-mount model. However, as will become fully evident below, the present invention is equally applicable to various types of refrigerators, including side-by-side models.

Arranged within freezer compartment 8 is an ice maker assembly 16. In a manner known in the art, ice maker assembly 16 includes an ice maker unit 18 and an ice storage bin 20. Ice maker unit 18 is shown to include a bale arm 26 which is pivotable upward and downward based on the amount of ice retained in storage bin 20. Bale arm 26 is actually pivotally connected to a switch arm 34.

Ice maker unit 18 also includes an ice mold 37. In general, this construction, as well as the operation of ice maker unit 18, is known in the art. Basically, the flow of water is directed to ice mold 37 by a fill tube 40 to fill up various cavities (not separately labeled) of ice mold 37 in order to produce ice cubes which are deposited into storage bin 20. In a typical ice maker arrangement, when the storage bin 20 has collected a sufficient number of ice cubes, the stored ice cubes will act on bale arm 26 to cause bale arm 26 to be lifted which, in turn, operates on switch arm 34 to de-activate ice maker unit 18. Bale arm 26 is biased downward to an ice making position such that, when a sufficient number of ice cubes are removed from storage bin 20, ice maker unit 18 will be automatically reactivated. Since the operation of automatic ice makers are widely known in the art, further details thereof will not be discussed here.

Figure 2:
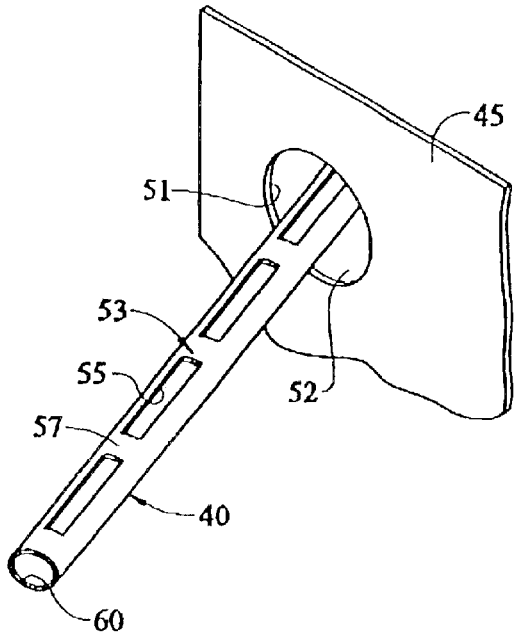
FIG. 2 is a perspective view of the fill tube assembly of FIG. 1.
Figure 3:
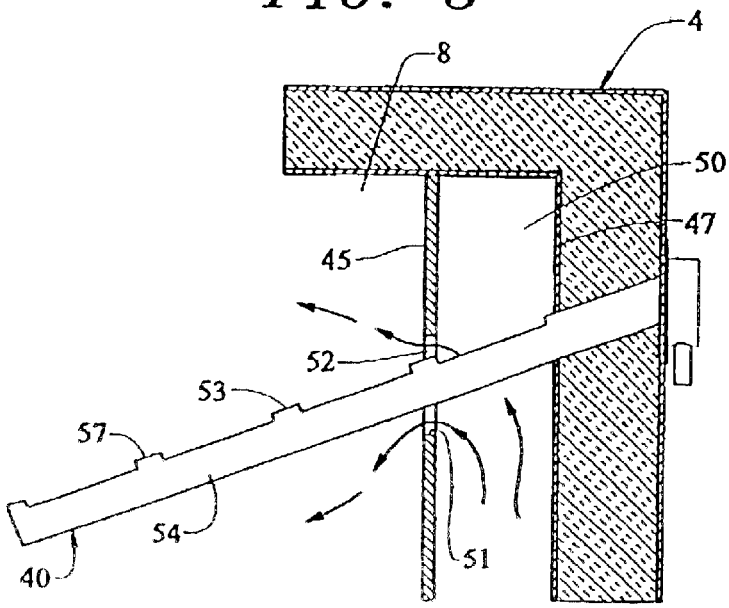
FIG. 3 is a cross-sectional view showing the fill tube assembly and a portion of the freezer compartment of FIG. 1.

The present invention is particularly directed to aspects of fill tube 40 of overall ice maker assembly 16. As previously mentioned, ice maker assembly 16 is located within freezer compartment 8. Freezer compartment 8 includes an evaporator coil cover 45, which includes air flow openings (not shown), and an insulated rear wall 47 (also see FIGS. 2 and 3) which is defined by a freezer liner. As best shown in FIG. 3, within cabinet 4, evaporator coil cover 45 and insulated rear wall 47 have a plenum 50 formed therebetween. Fill tube 40 extends through insulated rear wall 47, plenum 50, and evaporator coil cover 45. More specifically, evaporator coil cover 45 includes an opening 51 through which fill tube 40 passes, with a clearance 52 therebetween.

By positioning fill tube 40 so that it passes through plenum 50 and opening 51 in evaporator coil cover 45 with clearance 52, fill tube 40 is exposed to active ventilation with dehumidified freezer air. More particularly, air from plenum 50 is directed around fill tube 40 due to clearance 52 between fill tube 40 and evaporator coil cover 45. Ventilation with dehumidified freezer air sublimates ice from the surface of fill tube 40 and prevents ice restrictions within fill tube 40. In addition, fill tube 40 is exposed to heat which develops behind evaporator coil cover 45 during a freezer defrost cycle. This heat serves to melt any ice which may form within fill tube 40.

In accordance with the most preferred form of the invention, fill tube 40 includes a top or upper portion 53 and a bottom or lower portion 54. The top portion 53 of fill tube 40 includes a plurality of axially spaced vents 55 formed therein. Preferably, vents 55 take the form of elongated slots and fill tube 40 is formed of a flexible PVC material. As shown in FIG. 2, vents 55 are alternated with cross ribs 57 to help maintain the structure of fill tube 40 while allowing active venting of fill tube 40. On the other hand, bottom portion 54 of fill tube 40 is solid to allow water to flow through fill tube 40 to an outlet 60.

As indicated above, when refrigerator 2 performs a defrost cycle, warm air fills plenum 50. The warm air passes through opening 51 and surrounds fill tube 40. Warm air generated by a defrost cycle also enters vents 55 formed within fill tube 40 to prevent freezing of water within fill tube 40. Fill tube 40 is also exposed to dehumidified freezer air from behind inner wall 45 which helps to prevent ice formation on the surface of fill tube 40 and prevents ice restrictions within fill tube 40. Therefore, with this overall construction, an unobstructed supply of water to make ice cubes is available.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. A refrigerator freezer comprising:

an outer wall spaced apart from an inner wall, said inner wall being formed with an opening; and an ice maker assembly including:

a mold cavity for collecting liquid to be frozen; and a fill tube for transporting liquid to the mold cavity, said fill tube including at least one vent formed along its length, wherein the fill tube extends through the opening in the inner wall with a clearance between said inner wall and said fill tube to permit a flow of air about the fill tube through the clearance.

2. An ice maker assembly comprising:

a mold cavity for collecting liquid to be frozen; and a fill tube for transporting liquid to the mold cavity, said fill tube including at least one vent formed along its length, wherein said ice maker assembly is positioned in a refrigerator freezer having an outer wall spaced apart from an inner wall, said inner wall including an opening through which the fill tube extends, said fill tube extending through the opening with a clearance between said inner wall and said fill tube to permit a flow of the air about the fill tube through the clearance.

3. The ice maker assembly of claim 2, wherein the at least one vent includes a plurality of axially spaced vents.

4. The ice maker assembly of claim 3, wherein each of said vents takes the form of a slot.

5. The ice maker assembly of claim 4, wherein the fill tube includes an upper surface portion and a lower surface portion, said vents being formed in the upper surface portion.

6. A refrigerator freezer comprising:

an outer wall spaced apart from an inner wall, said inner wall being formed with an opening; and an ice maker assembly including:

a mold cavity for collecting liquid to be frozen; and a liquid fill tube for transporting liquid to the mold cavity, wherein the liquid fill tube extends through the opening in the inner wall with a clearance between said inner wall and said liquid fill tube to permit a flow of air about the fill tube through the clearance.

7. The refrigerator freezer of claim 6, wherein the liquid fill tube is formed with a plurality of longitudinally spaced vents.

8. The refrigerator freezer of claim 7, wherein each of said vents takes the form of a slot.

9. The refrigerator freezer of claim 8, wherein the fill tube includes an upper surface portion and a lower surface portion, said vents being formed in the upper surface portion.

10. The refrigerator freezer of claim 6, wherein said inner wall constitutes an evaporator coil cover.

11. The refrigerator freezer of claim 6, wherein said outer wail constitutes an insulated wall of a freezer liner.

12. A method of preventing ice from forming in an ice maker fill tube of a refrigerator comprising the steps of:

generating a flow of warm air in a plenum located between an inner wall, which is formed with an opening, and an outer wall of a refrigerator freezer compartment by running a defrost cycle in the refrigerator; and warming the fill tube, that extends through the plenum and the opening in the inner wall, by allowing the warm air to flow around the fill tube through a clearance formed between the fill tube and the opening of the inner wall.

13. The method of claim 12, further comprising: warming the fill tube by allowing the warm air to enter at least one hole formed within the fill tube.

14. The method of claim 13, further comprising: allowing the warm air to enter any one of a plurality of axially spaced holes formed along an upper surface portion of the fill tube.

* * * * *